United States Patent [19]

Persson

[11] Patent Number: 4,615,374

[45] Date of Patent: Oct. 7, 1986

[54] FOUNDRY PLANT AND A MANOEUVERING APPARATUS FOR USE IN IT

[75] Inventor: Viggo Persson, Nivaa, Denmark

[73] Assignee: Dansk Industri Syndikat A/S, Denmark

[21] Appl. No.: 677,547

[22] PCT Filed: Apr. 17, 1984

[86] PCT No.: PCT/DK84/00032

§ 371 Date: Nov. 20, 1984

§ 102(e) Date: Nov. 20, 1984

[87] PCT Pub. No.: WO84/04061

PCT Pub. Date: Oct. 25, 1984

[30] Foreign Application Priority Data

Apr. 18, 1983 [DK] Denmark ..... 1683/83

[51] Int. Cl.[4] ..... B22C 25/00

[52] U.S. Cl. ..... 164/442; 164/213; 164/241

[58] Field of Search ..... 164/18, 27, 159, 180, 164/213, 235, 241, 401, 409, 412

[56] References Cited

U.S. PATENT DOCUMENTS

| | | | |
|---|---|---|---|
| 775,374 | 11/1904 | Melvin | 164/180 |
| 4,155,401 | 5/1979 | Ettore | 164/213 |
| 4,378,835 | 4/1983 | Janke | 164/200 |

FOREIGN PATENT DOCUMENTS

| | | | |
|---|---|---|---|
| 0059551 | 9/1982 | European Pat. Off. | 164/322 |
| 815859 | 7/1959 | United Kingdom | 164/409 |

*Primary Examiner*—Nicholas P. Godici
*Assistant Examiner*—Richard K. Siedel
*Attorney, Agent, or Firm*—Larson & Taylor

[57] ABSTRACT

A manoeuvering system for a foundry plant for the automatic manoeuvering of heavy implements includes two carrier pins located on the same side of each implement. A carriage is movably mounted to a frame and a gripper including two jaws as attached to the carriage. This gripper is rotatably mounted to the carriage so that the implement can be rotated as well as moved longitudinally.

6 Claims, 5 Drawing Figures

FOUNDRY PLANT AND A MANOEUVERING APPARATUS FOR USE IN IT

Figure 1:
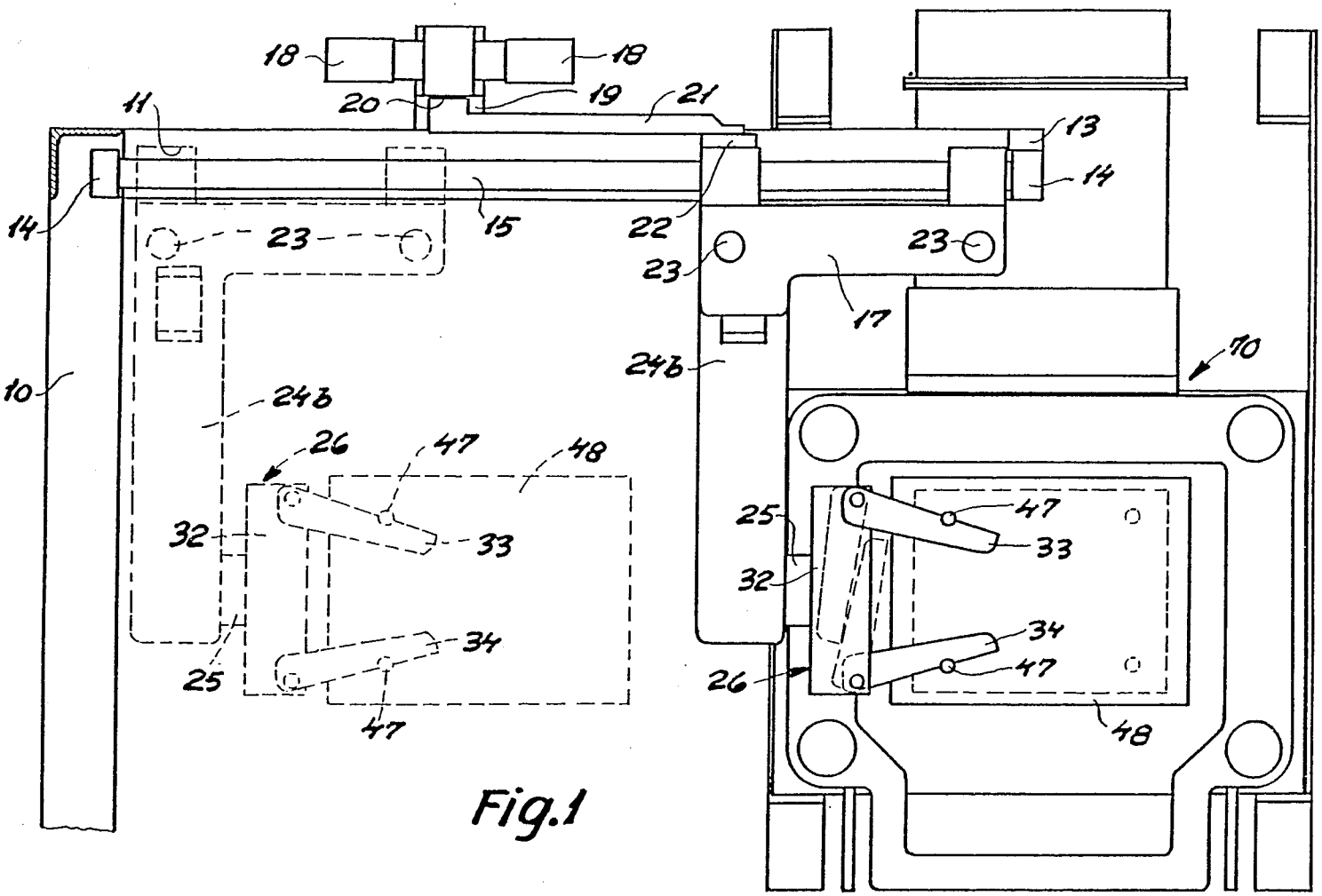

The invention relates to a foundry plant with a manoeuvring apparatus for automatic manoeuvring of loads in the form of heavy, movable or exchangeable parts incorporated in the plant, such as core masks, pattern plates and core box parts, said manoeuvring apparatus having a gripper rotatably mounted on a carriage or a slide and having at least two jaws capable of being moved between a rest position and an operative position.

Various forms of manoeuvring devices for automatic core feeding are known, e.g. from the British Patent Specifications Nos. 1 057 548 and 1 144 598 and the Danish Patent Specification No. 144 847. The Danish Patent Specification 125 776 (U.S. Pat. No. 3,901,304) discloses a truck for use in pattern plate exchange in automatic machines for making mould parts. All of these known devices are specialized in the sense that they are only designed to perform a specific function.

The invention is based on the finding that the various functions in the operation of automatic foundry plants, such as core feeding, exchange of core masks and exchange of pattern plates, offer so many points of resemblance that it must be possible to simplify a foundry plant and its operation to some degree by utilizing these points of resemblance, and the object of the invention is to provide such a simplified plant.

This object is achieved in that each of the parts to be manoeuvred by the apparatus is provided with at least two carrier pins disposed on the same side of the part, and that the jaws are designed to engage the carrier pins upon movement from the rest position to the operative position to establish a holding grip and are formed with cutouts or depressions to receive the carrier pins. The standardization brought about by providing all the parts of the plant which are relevant in the given connection as manoeuvring objects with uniform engagement elements, makes it possible to handle all of them with the same manoeuvring apparatus.

The invention also relates to a manoeuvring apparatus for use in the foundry plant comprising a gripper which is rotatably and slidably mounted on a slide and has jaws provided with engagement elements to cooperate with carrier pins on the parts of the plant which constitute loads to be manoeuvred, said jaws being pivotable about their respective shafts on the slide or carriage between a rest position and an operative position by means of piston/cylinder devices. When this apparatus is so constructed that each jaw is connected to its piston/cylinder device through a link whose ends are rotatably connected to the free end of the piston rod in the piston/cylinder device whose cylinder is pivotally mounted on the slide or carriage, and the jaw, respectively, and the end of the link connected to the piston rod is so controlled by a cam means on the slide or carriage that the thrust from the load in the operative position of the jaws causes the end of the link in question to assume an end position, which corresponds to the operative position, in engagement with a blocking portion on the cam means, the thrust with which the load acts on the jaws contributes in keeping these in the operative position so that the jaws are self-blocking in this position and in a loaded state.

In practice, a clear indication of the operative positions of the jaws can be expediently obtained when a cam roller, which is disposed on said controlled end of the link in co-axial relationship with said controlled rotatable connection, engages the cam means, which is formed with an end stop for the cam roller in the operative position of the jaw. Enhanced certainty of the jaws remaining in their operative positions until their cylinder assemblies are activated to move them to their rest positions is obtained when the cam means between the end portion corresponding to the operative position of the jaw and the remaining part is formed with a low ridge, whose apex is formed by a ball spring loaded toward the cam face.

A high degree of manoeuvring freedom is obtained when the manoeuvring apparatus has a preferably box-shaped gripper housing in which the cylinder assemblies and the cam means are placed, and two jaws which are disposed in the same plane and are pivotable between their rest positions in which they are positioned side by side in the gripper housing, and their operative positions in which their engagement elements engage the faces of the carrier pins of the load which face each other. Thus, in the rest positions the jaws are collapsed right into the gripper housing which can be moved close to and also closed by the parts to be manoeuvred and fixed machine parts as well as other transport mechanisms such as conveyor belts for conveying core masks from a store to a location where they can be picked up by the gripper.

In a particular embodiment the engagement elements on the parts to be manoeuvred are constituted by carrier pins formed with annular grooves of a trapezoidal cross section with inwardly converging side walls, and the engagement elements on the jaws in the form of oblong plates are constituted by edge cutouts intended to receive the pins, and the edges of the cutouts are bevelled corresponding to the shape of the grooves in the carrier pins. This embodiment of the engagement elements, even when made with moderate dimensions, provides for relatively large contact faces and a certain wedge effect giving a firm and secure grip.

Figure 2:
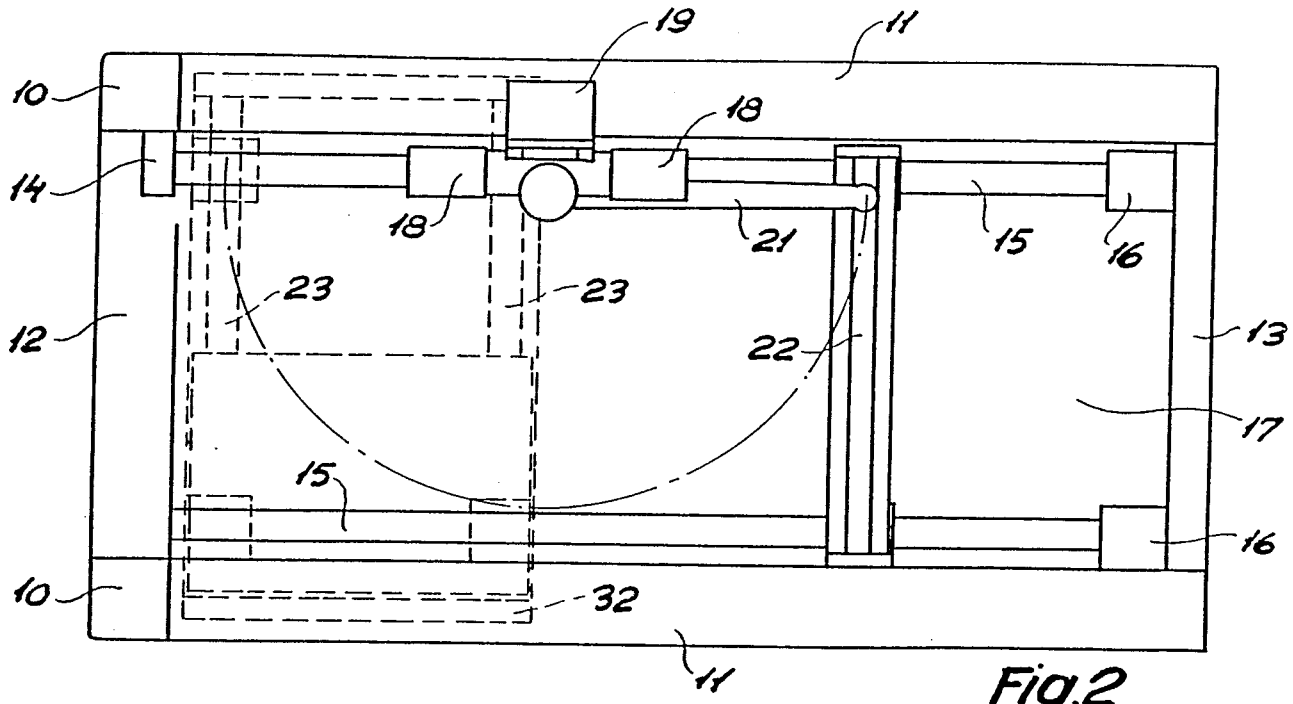
Figure 3:
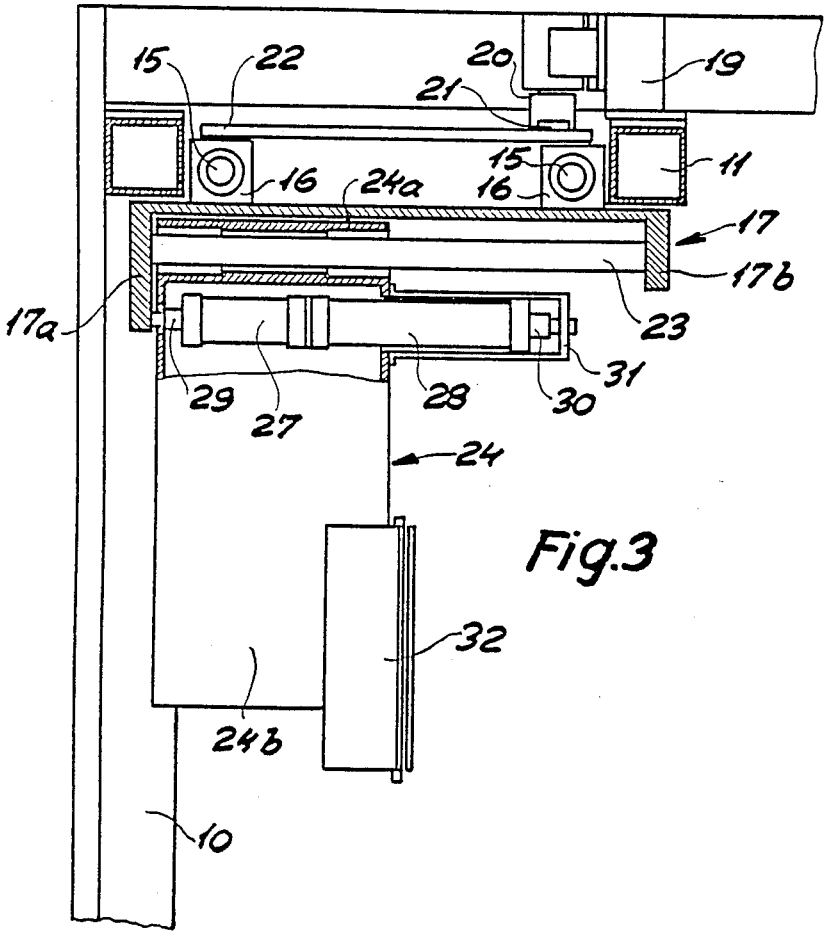
Figure 4:
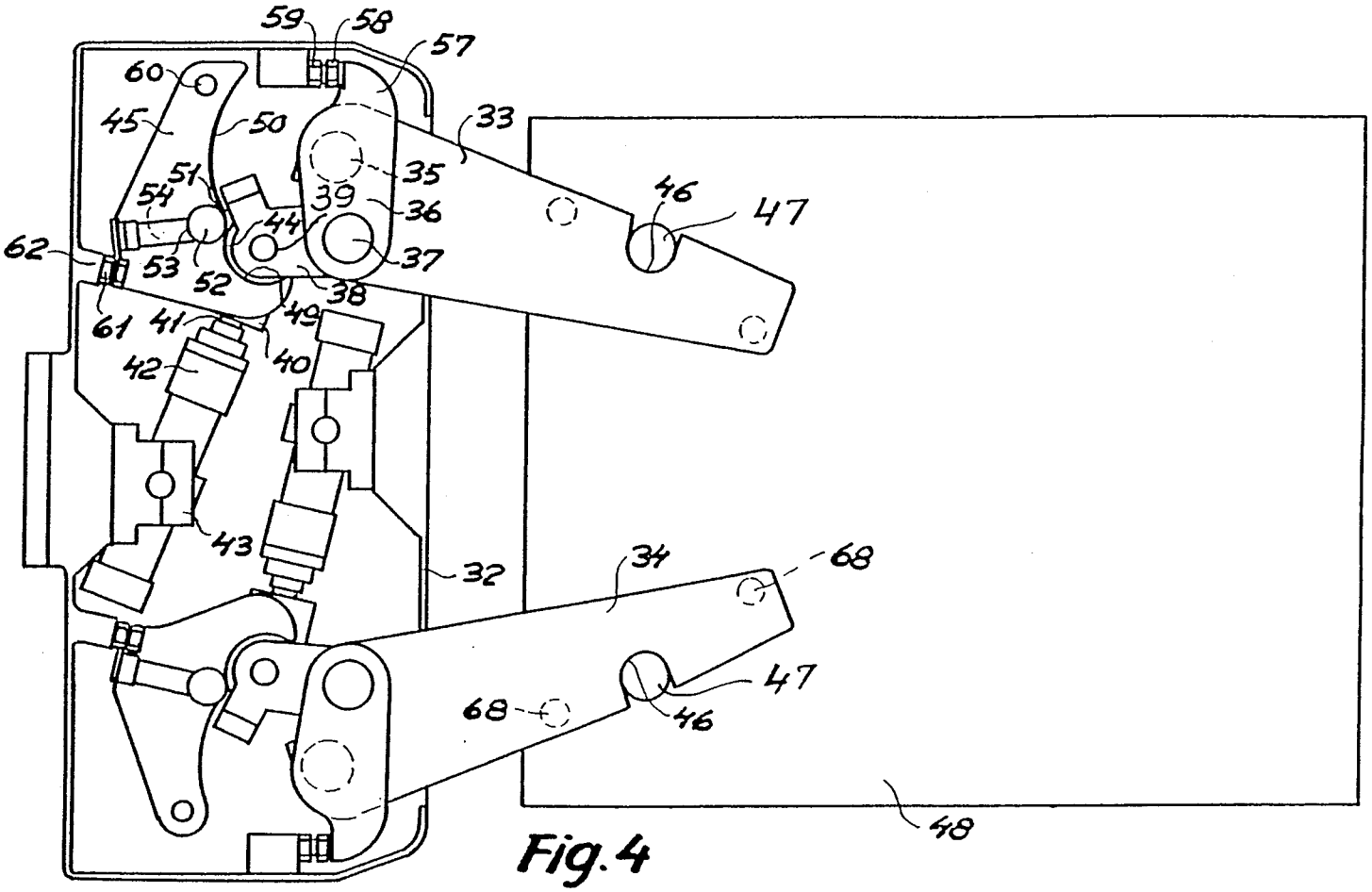
Figure 5:
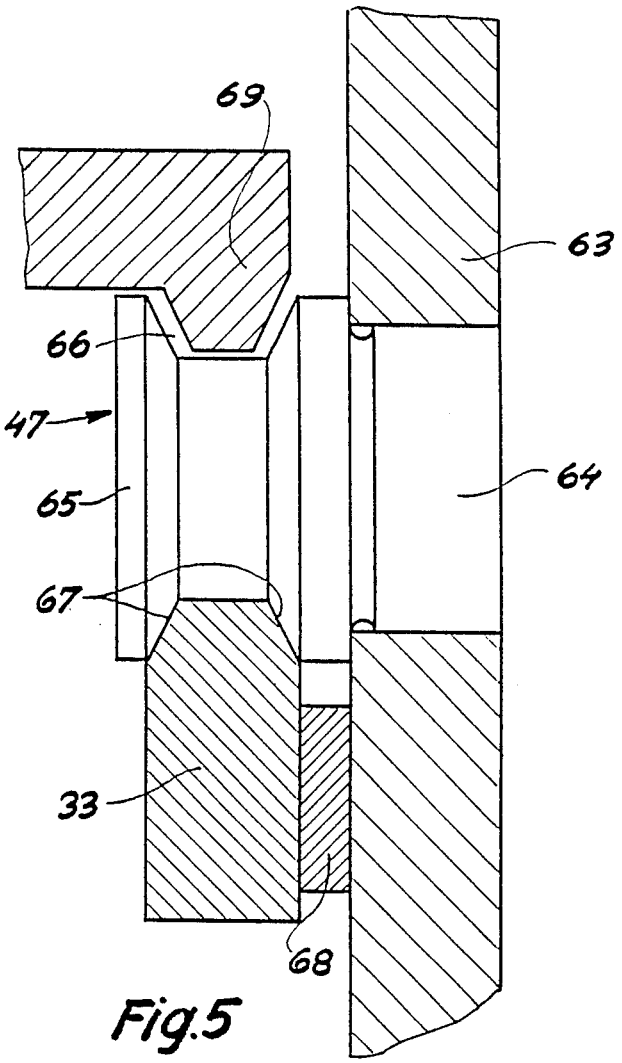

The invention will be explained more fully below with reference to the drawings, in which FIGS. 1, 2 and 3 are schematic and partly sectional views of an embodiment of the manoeuvring apparatus of the invention, seen from the side, from above and from the end, respectively, FIG. 4 shows in greater detail the gripper, seen from the side, and FIG. 5 is a vertical section through a part of a pattern plate with an element of engagement and holding means cooperating with it.

The manoeuvring apparatus of FIGS. 1–3 has a carrier frame with corner posts 10, upper longitudinal girders 11 and upper transverse girders 12 and 13. Two cylindrical guides 15 extending in parallel with and at a short distance from the longitudinal girders 11 are fixed between four brackets 14, two of which are secured to the corner posts 10 and the other two to the transverse girder 13. A carriage 17 is suspended from the guides by means of bearing brackets 16 and is slidable between two positions at the respective ends of the guides, shown in solid and dashed lines in FIGS. 1 and 2, respectively. These sliding movements can be effected by two hydraulic cylinders 18 secured to one longitudinal girder 11 by means of a bracket 19; the cylinders 18 secure between them a toothed rack (not shown) which is engaged with a tooth sector (not shown) secured on a vertical, rotatable shaft 20. The lower end of the shaft mounts an arm 21 of a length corresponding to half the length of travel of the carriage 17. The arm 21 carries on its outer end a pin (not shown) extending into a guideway 22 which is placed on top of and extends between two of the bearing brackets 16 in a direction perpendicular to the guides 15. When the arm 21 is pivoted through an angle of 180° from one extreme position shown in FIG. 2 to the other, its pin will thus reciprocate in the guideway 22, moving the carriage 17 from the extreme position shown in solid lines in FIG. 2 to the one shown in dashed lines.

The carriage 17 has two downwardly directed side flanges 17*a* and 17*b*, the first one 17*a* being somewhat higher than the other. Two cylindrical transverse guides 23 are clamped between these flanges and slidably mount the upper horizontal part 24*a* of an angular slide 24. Near one lower corner of the rectangular vertical part 24*b* of the slide is rotatably journalled a short, solid shaft 25 which carries a gripper 26 and can be rotated by a hydraulic, pneumatic or electric moving mechanism of a generally known type (not shown) contained in the vertical slide part 24*b*.

At the top of the slide 24 there are mounted two hydraulic cylinders 27 and 28 of different length, back to back and co-axially with each other and parallel with the guides 23. The free end of the piston rod 29 of the short cylinder 27 is secured to the high flange 17*a* of the carriage 17, and the free end of the piston rod 30 of the long cylinder 28 is secured to the base part of a U-shaped yoke 31, whose legs are secured to the slide 24. Activation of the short cylinder 27 thus displaces the slide 24 a distance corresponding to the stroke of this cylinder on the guides 23 from the position shown in FIG. 3, and upon activation of the long cylinder 28 the slide is additionally displaced a distance corresponding to the greater stroke of this cylinder transversely to the path of travel of the carriage 17. Reverse activation of the cylinders results in two other indicated slide positions.

As shown best in FIG. 4, the gripper 26 has a housing 32 which is shaped as a relatively narrow box and in which two co-planar jaws 33 and 34 in the form of oblong plates are pivotally journalled about axes which are perpendicular to this plane. The two jaws have their respective moving and control mechanisms which are constructed and operate in the same manner; therefore only the mechanism associated with the upper jaw 33 in FIGS. 1 and 4 will be described in detail below.

The jaw 33 is fixedly mounted on a rotatable shaft 35. This shaft also mounts an arm 36 at some axial distance from the jaw 33. Between the elements 33 and 36 there is mounted a pin 37 on which one end of a link 38 is rotatably connected, by means of a pivot 39, to a cross head 40 on the free end of the piston rod 41 in a hydraulic cylinder 42 which is pivotally mounted at the middle between two bearing brackets 43.

The pivot 39 rotatably mounts a cam roller 44 which cooperates with a cam plate 45 secured to the housing 32. In FIG. 4 the jaws are shown in solid lines in their operative positions in which a cutout 46 in their outwardly directed side edges engage pins 47 on the part which is to be manoeuvred and which is shown in the drawing as a rectangular plate 48, which may e.g. represent a core mask. In this position the load 48 affects the jaw 33 with a thrust which produces a torque in the clock-wise direction, FIG. 4, to cause the link 38 to bring the cam roller 44 into engagement with a blocking portion 49 of the cam edge of the cam plate. This blocking portion forms an end stop for the cam roller and is spaced from the remaining part 50 of the cam edge by a ridge 51, whose central portion is a roller 52 which is placed in a cutout 53 in the cam plate 45 and is under the action of a compression screw spring 54. The cam roller 44 can be caused to leave the blocking portion 49 only when the cylinder 42 pushes its piston rod 41 out so that the cam roller 44 first urges the ball 52 inwards against the action of the spring 54 and simultaneously rotates the link 38 about the pivot 37 until the cam roller 44 engages a fixed guide means, and then it follows the cam edge portion 50 under the combined influence of the cylinder 42 and the weight of the jaw 33 until the piston 41 reaches its extreme position. During this movement of the cam roller 44, the jaw 33 moves from the operative position shown in solid lines to the rest position shown in dashed lines in which it is entirely located in the gripper housing 32. The arm 36 is formed with a rearward extension 57 carrying an adjustable stop means 58 which cooperates with a fixed stop 59 to restrict the outward pivotal movement of the jaw.

Also the other jaw 34 is shown in its operative position in solid lines and in its rest position in dashed lines. As the two jaws are co-planar, their drive cylinders must be controlled so that the upper arm 33 is drawn in before the lower arm 34.

In the construction shown, the cam plate 45 is pivotally mounted on a pivot 60 and is provided with a setting screw 61 which engages a fixed stop 62 and thus allows adjustment of the cam plate position.

The elements of engagement on the parts to be manoeuvred can be formed as shown in FIG. 5, where 63 represents a part of e.g. a pattern plate, and the engagement element 47 has a cylindrical stem 64 secured in a hole in the plate 63 and an engagement portion in the form of a cylinder 65 provided with an annular groove 66 of trapezoidal cross-section. The edge portion of the jaw 33 defining the cutout 46 is bevelled as shown at 67 so as to have the same cross-section as the groove 66 in the cylindrical pin 65.

On the side facing the load the jaws 33 and 34 have two flat bosses 68 which, in their gripping positions, engage the plane face of the load on which the engagement pins 47 are placed, so as to contribute to the stabilization of the load with respect to the jaws.

The engagement pins 47 can also be used for fixing pattern plates and core masks in magazines or elsewhere by means of suitable holding means, such as those shown at 69 in FIG. 5 which engage the engagement pins from the exterior.

In FIG. 1 the carriage 17 and the gripper 26 are shown in a position in which the gripper 26 holds the core mask 48 ready for feeding of cores into a mould newly produced by an automatic mould producing machine shown schematically at 70. The feeding of cores can then take place by displacement of the slide 24 on the transverse guides 23 upon activation of one or both of the cylinders 27 and 28. When the carriage 17 is in the position shown in dashed lines in FIG. 1, the slide movements can e.g. be used for removing core masks or pattern plates or for that matter individual big cores from a magazine or feeding into it. The circumstance that the gripper 26 can be rotated about the axis of the shaft 25 also makes it possible to use it for picking up core masks or the like from a conveyor belt on which they are fed lying, and then automatically cause them to assume a core feeding position. Conversely, it can of course also place core masks or the like on a conveyor belt for further transport.

I claim:

1. In a foundry plant, a manoeuvring system for automatic manoeuvring of loads in the form of heavy, movable or exchangeable implements such as core masks, pattern plates and core box parts, the manoeuvring system comprising:

two carrier pins for each implement, said two carrier pins for each implement being disposed on the same side of the implement;

a frame;

a movable carriage movably mounted on said frame;

a moving means for moving said carriage relative to said frame, a gripper for the implements, said gripper including two jaws, a positioning means for moving said jaws from a converged collapsed position to a diverged operative position, and a cutout provided on each jaw such that in the operative position said cutouts are on opposite sides of said jaws whereby said cutouts engage respective pins of the implement; and a gripper rotating means for rotatably mounting said gripper to said carriage such that after said gripper engages the implement, the implement is manoeuvrable by said rotating means and by said moving means.

2. A manoeuvring system as claimed in claim 1, wherein said gripper rotating means includes (a) a gripper shaft to which said gripper is attached, and (b) a gripper shaft mounting means for rotatably journalling said gripper shaft to said carriage about a longitudinal axis of said gripper shaft, wherein said gripper includes (a) two jaw shafts, with a respective jaw mounted on a respective jaw shaft, said jaw shafts being rotatable about their respective longitudinal axes to rotate said jaws between the collapsed position and the operative position, and (b) a respective piston/cylinder device which rotates a respective said jaw shaft, each said piston/cylinder device including a piston with a free end and a cylinder; and further including (a) respective link provided for each respective said jaw having a first end which is rotatably attached to the free end of the piston rod of a respective said piston/cylinder device and a second end which is rotatably attached to the respective said jaw, (b) a cylinder mounting means for each respective said cylinder for pivotably mounting said respective cylinder to said carriage, (c) a cam means provided for the first end of each said link for controlling the thrust from the implement when said jaws are in the operative position such that the first end of said respective link is moved to an operative position, and (d) a locking means for engaging said cam means when said cam means is in the operative position.

3. A manoeuvring system as claimed in claim 2 wherein each said pin has an annular groove thereabout having a trapezoidal cross section converging inwardly, wherein each said jaw is formed by an oblong plate, and wherein each said cutout is formed in an edge of a respective said plate with each said cutout being bevelled so as to mate with the trapezoidal shape of said grooves of said pins.

4. A manoeuvring system as claimed in claim 2 and further including a respective cam roller which is located on a respective first end of each said link and which is rotatably connected to said first end coaxial with the rotatable connection of the respective said first end and the respective said piston, said cam roller engaging said cam means; and an end stop on each respective said cam means for stopping each respective said cam roller in the operative position of the respective said jaw.

5. A manoeuvring system as claimed in claim 4 wherein said cam means includes a low ridge, said low ridge being formed by a ball and by a spring means for urging said ball into position to form said low ridge.

6. A manoeuvring system as claimed in claim 4, further including a box-shaped gripper housing in which said piston/cylinder devices and said cam means are located; and wherein said positioning means disposes said two jaws for pivotal movement in the same plane such that said jaws are pivotable between the rest position where said jaws are positioned side by side in said gripper housing and the operative position where said jaws are engaged to surfaces on respective said pins which pin surfaces face one another.

* * * * *